US005330214A

United States Patent [19]

Brooks et al.

[11] Patent Number: 5,330,214

[45] Date of Patent: Jul. 19, 1994

[54] SIMPLIFIED STEERING MECHANISM FOR SKATEBOARDS AND THE LIKE

[76] Inventors: Paul F. Brooks, 708 E. 8125 South, Sandy, Utah 84094; Ken D. Lisonbee, 3185 W. 8600 South, West Jordan, Utah 84088

[21] Appl. No.: 93,358

[22] Filed: Jul. 19, 1993

Related U.S. Application Data

[63] Continuation-in-part of Ser. No. 988,868, Dec. 8, 1992, Pat. No. 5,232,235, which is a continuation-in-part of Ser. No. 754,008, Sep. 3, 1991, Pat. No. 5,169,166.

[51] Int. Cl.[5] ..... A63C 17/01

[52] U.S. Cl. ..... 280/87.042; 280/11.27; 280/112.2

[58] Field of Search ..... 280/11.19, 11.27, 11.28, 280/22.1, 87.041, 87.042, 86, 100, 111, 112.2, 688

[56] References Cited

U.S. PATENT DOCUMENTS

| | | | |
|---|---|---|---|
| 2,509,324 | 5/1950 | Van Horn | 280/11.28 |
| 3,331,612 | 7/1967 | Tietge | 280/87.042 X |
| 4,020,914 | 5/1977 | Trautwein | 280/112.2 X |
| 4,036,506 | 7/1977 | Scheib | 280/22.1 |
| 4,398,734 | 8/1983 | Barnhard | 280/11.28 |
| 4,740,004 | 4/1988 | McMullen | 280/112.2 X |
| 4,998,596 | 3/1991 | Miksitz | 280/112.2 X |
| 5,040,812 | 8/1991 | Patin | 280/112.2 X |
| 5,161,810 | 11/1992 | DeCesare | 280/14.2 |

*Primary Examiner*—Margaret A. Focarino
*Assistant Examiner*—Michael Mar
*Attorney, Agent, or Firm*—Bryan A. Geurts

[57] ABSTRACT

A novel, simplified steering mechanism is provided which has both wheel tilting and steering capabilities. The steering mechanism comprises generally a platform, an angled plunger, top and bottom axles of equal length, and a pair of wheels. When a downward vertical force is applied to a side of the platform, the platform and plunger tilt towards that force, thereby causing tilting and directional changes in the wheels. The axles are of such a length that the platform and wheels cannot come into contact with each other, even upon exertion of a downward vertical force.

13 Claims, 3 Drawing Sheets

SIMPLIFIED STEERING MECHANISM FOR SKATEBOARDS AND THE LIKE

This application is a continuation-in-part of co-pending application Ser. No. 07/988,868, filed Dec. 8, 1992, now U.S. Pat. No. 5,232,235 which is a continuation-in-part of Ser. No. 07/754,008, filed Sep. 3, 1991, now U.S. Pat. No. 5,169,166.

BACKGROUND

1. Field

This invention relates generally to the field of weight change responsive steering mechanisms, such as those commonly used with skateboards, and more specifically to a novel, simplified steering mechanism which offers the advantages of simultaneous steering and wheel tilting.

2. Prior Art

Steering mechanisms which respond to weight changes made by the operator/rider, usually known as trucks, are well known in the art. In most instances, trucks are attached to the bottom broad face of a platform, or similar planar member, upon which a weight rests or stands. Responsive to a change in the center of mass of the weight from one side to another, the platform tilts slightly to cause the truck to change the direction in which the corresponding wheels are pointing. Thus, a rider balanced atop a skateboard shifts his or her weight to one side or the other depending on the direction desired.

Generally, the wheels used with such trucks are relatively small in diameter, while having a relatively substantial width (the width often exceeds the diameter). Also, these wheels are usually close together, and therefore disposed underneath the platform. U.S. Pat. Nos. 2,509,324, issued to Van Horn in 1950, and U.S. Pat. No. 4,398,734, issued to Barnard in 1983, are typical of such trucks and wheels, and embody the typical arrangement in skateboards.

Both the Barnard and Van Horn patents disclose a plunger which is rigidly affixed at one end to the bottom face of a platform, the free end of the plunger extending downwardly therefrom. An axle having wheels rotatably attached at both ends is affixed to the free end of the plunger, the axle including a leg which extends forwardly. The forwardly extending end of the leg is in communication with a leg holder such that universal movement of the leg's free end is allowed.

In this manner, when the center of mass of a weight atop the platform is shifted to one side of the platform or the other, the platform and plunger correspondingly shift or tilt slightly, the plunger thereby causing the axle and wheels to turn in a different direction.

While adequate for a number of applications, the type of steering truck just described includes a number of disadvantages as well. For example, this configuration requires that the wheels be fairly close together. This can become a problem when the truck is called upon to make sharp turns since the platform may tilt far enough over to make contact with the wheels. Thus, this configuration not only limits the turning radius of this type of steering mechanism, but the platform contacting the wheels can cause a dangerous situation as well.

For instance, many skateboard riders lean extremely hard into sharp turns, particularly when traveling at a high rate of speed. When this happens, it is not only conceivable, but probable, that the exertion of such a force on the edge of the skateboard platform will cause a tilting of the platform with respect to the wheels such that the platform and wheels come in contact, thereby throwing the rider off balance and probably causing an accident. Also, if the platform can come into contact with the wheels during such a turn, undue wear and tear is caused on both the wheels and the platform.

Another problem caused by the configuration mentioned above is the size of the wheels. While providing a greater contact area with the ground, such wheels cannot tilt into a turn to assist in gripping the ground surface. Indeed, even assuming that such steering mechanisms provide for tilt in the wheels, which they do not, the extra wide wheels commonly used on skateboards could not be tilted during a turning maneuver without virtually eliminating the ground contact sought to be maintained by use of the wide wheels. Thus, without the ability to tilt, horizontal forces experienced during the course of a turn, caused by the tendency of an object to travel in straight path, must be completely absorbed by frictional forces between the wheels and the ground.

Furthermore, Applicant's prior applications dealing with steering mechanisms which have both steering and tilting capabilities are fairly complex. Hence, the steering mechanisms covered by these applications can be more expensive than desired, and may tend to break down and be more difficult to repair and maintain.

Therefore, there exists in the prior art a legitimate need for a steering mechanism which not only provides steering capabilities, but also provides tilting capabilities as well to allow enhanced turning capacity. Further, a steering mechanism which provides these capabilities and which is constructed in a simpler fashion is even more desirable.

BRIEF SUMMARY AND OBJECTS OF THE INVENTION

Accordingly, the present invention seeks to overcome the above mentioned and other difficulties experienced in the prior art by achieving the following objects and advantages.

A principle objective of the present invention is to provide a novel steering truck mechanism which combines steering capabilities with tilting capabilities in a simplified manner.

Another major object of the present invention is to provide a simplified steering mechanism which is controlled by the transfer of weight about various points on a platform, said platform tilting slightly in response to the transfer of weight.

A further important object of this invention is the provision of a novel simplified steering mechanism controlled by weight transfer wherein the platform cannot come in contact with the wheels.

Yet another major object of the present invention is to provide a steering mechanism which includes larger wheels which have increased rotating capacity over smaller prior art wheels relative to the ground due to decreased friction.

Still another major objective of the invention is to provide a high performance steering mechanism for use with skateboards which allows safe travel at higher speeds due to a wider wheel base and an increased turning capability due to tilting wheels.

It is a further object of the present invention to provide a steering truck mechanism which is simpler in its functions, easier to maintain and repair, more efficient, more durable, more easily assembled, lighter weight, more easily manufactured, and safer than prior art devices.

These and other objects and advantages of the invention will become more fully apparent from the description and claims which follow or may be learned by the practice of the invention.

The simplified steering mechanism of the present invention comprises generally a platform which is mostly planar, a plunger, top and bottom axles, and a pair of wheels. The plunger includes proximate and distal ends, the proximate end being rigidly affixed to the bottom broad face of the platform, and the distal end angling downwardly from the platform.

Preferably, the downwardly angled plunger forms an acute angle with the plain of the platform. While the allowable range of angle sizes of the acute angle formed is between 10 and 80 degrees, best results are realized when the angle is between 15 and 45 degrees. The optimum size of the acute angle formed is 30 degrees, which provides an adequate turning radius for a wide range of purposes, as well as optimum tilting capabilities. One skilled in the art will recognize that by varying the acute angle formed between the plunger and the plain of the platform, the turning radius of the turning mechanism may be altered.

Advantageously, the proximate end of the plunger forms an attachment plate whereby the plunger is rigidly affixed to the bottom broad face of the platform. In order to more fully facilitate replacement and maintenance of the top and bottom axles and other component parts, the plunger is preferably comprised of a first piece and a second piece. The first piece is rigidly affixed to the attachment plate at the proximate end of the plunger and therefore is an integral part thereof. On the other hand, the second piece is demountably affixed to the first piece by the use of screws or some other common method of fastening. In this manner, both the top and bottom axles and other component parts can be replaced without having to replace the entire steering mechanism.

Both the top and bottom axles are preferably of equal length and are disposed in a parallel aligned relationship to each other. Each of these axles intersects and is pivotally securely to the plunger at its approximate mid-length. Such pivotal securement is best achieved by use of a pivot pin which is attached at both ends to the plunger and which passes through an aperture in each of the axles. With this configuration, when a downward vertical force is exerted on one of the longitudinal sides of the platform, the axles temporarily assume a parallel but nonaligned relationship to each other, thereby causing the wheels to tilt relative to the platform.

One end of both the top and bottom axles is pivotally secured to one of the wheels, while the other end of both axles is pivotally secured to the other wheel. Importantly, the axles are of such a length that the wheels do not come in contact with the platform upon exertion of a downward vertical force on one of the longitudinal sides of the platform. Also, one skilled in the art will recognize that both the top and bottom axles advantageously intersect the plunger at right angles.

The preferred wheels, which are significantly larger in diameter and thinner in width than conventional skateboard wheels, comprise a hub, a tire, a race, and a set of ball bearings. It is the hub to which an end of both the top and bottom axles is pivotally secured. Importantly, the race is fixedly attached to the inner interior surface of the tire and the ball bearings are disposed between the race and the hub such that the hub remains in a stationary position while the race and tire rotate when the steering mechanism is in motion.

One skilled in the art will recognize that provision must be made for returning and maintaining the steering mechanism in a neutral position when the longitudinal sides of the platform are not acted upon by a downward vertical force. In the present invention, such provision is made in the form of rubberized cushions which are wrapped about the top axle on either side of the intersection of the top axle with the plunger.

In its preferred use, a pair of identical, but oppositely disposed, steering mechanisms are combined with a generally planar platform to form a skateboard assembly for recreational and competitive use. In this configuration, the platform further comprises a transverse midline towards which each of the acutely angled plungers angles, one steering mechanism being disposed on either side of the transverse midline.

In use, a rider or operator of the skateboard assembly is balanced atop the platform. A downward vertical force is supplied by the rider/operator by shifting his or her weight towards one side or the other of the platform. The exertion of such a force causes the platform and plunger to tilt toward the applied force thereby bringing the top and bottom axles out of an aligned relationship to cause the wheels to tilt. Simultaneously, the angled plunger causes the wheels to change directional alignment to provide steering capabilities.

BRIEF DESCRIPTION OF THE DRAWINGS

In order that the manner in which the above recited and other advantages and objects of the invention are obtained can be appreciated, a more specific description of the invention briefly described above will be rendered by reference to specific embodiments thereof which are illustrated in the appended drawings. Understanding that these drawings depict only typical embodiments of the invention and are not therefore to be considered limiting of its scope, the invention will be described and explained with additional specificity and detail through the use of the accompanying drawings in which.

DETAILED DESCRIPTION

Figure 1:
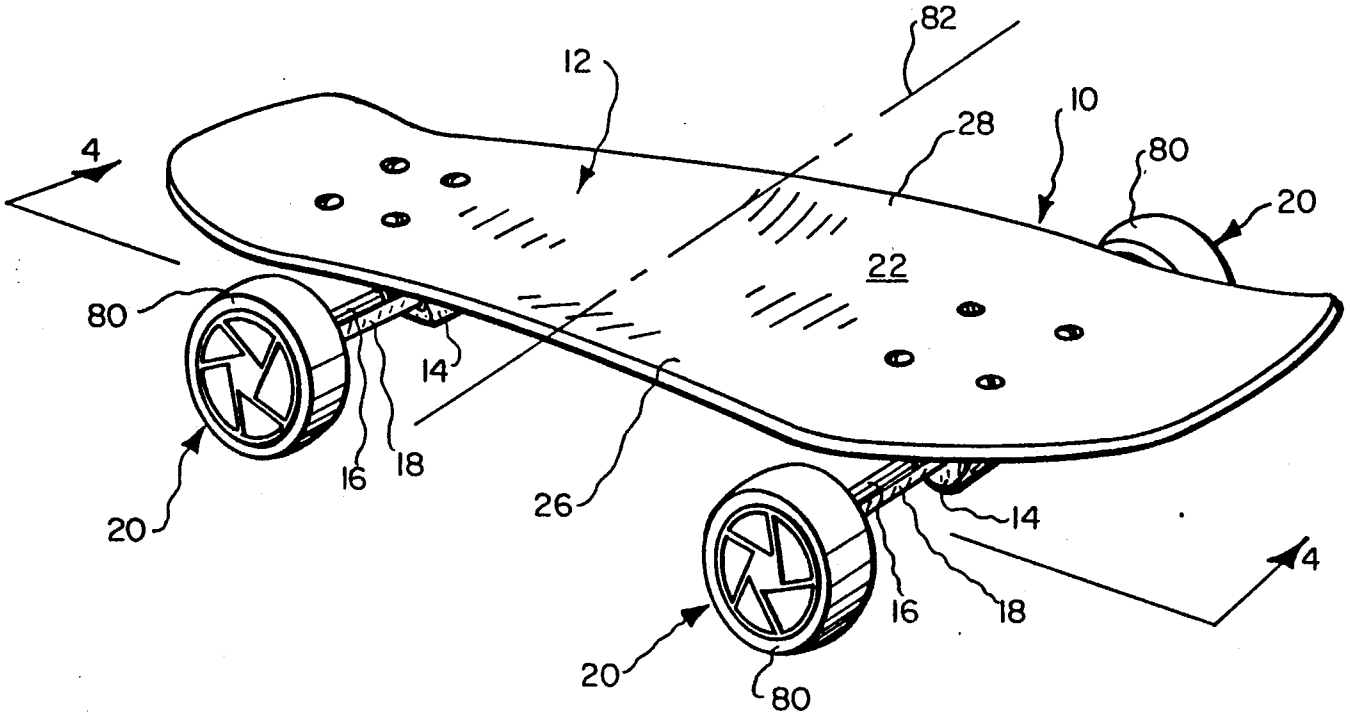
FIG. 1 is a top front perspective view of the preferred embodiment of the present invention in the form of a skateboard assembly.

Reference is now made to the drawings wherein like numerals are used to designate like component parts throughout. The simplified skateboard steering mechanism of the present invention which is presently preferred, generally designated 10, includes both wheel tilting and steering capabilities, and comprises generally a platform 12, a plunger 14, top and bottom axles 16 and 18 respectively, and a set of wheels 20. Each of these components will be described in greater detail hereafter.

Platform 12 is preferably a rigid member which is generally planar and which may take a variety of different shapes. One preferred shape thereof is substantially rectangular such as may be used in conjunction with a skateboard. One skilled in the art will recognize that the shape of the platform 12 is best determined by the desired use of the steering mechanism 10.

Advantageously, the platform 12 is constructed of a substantially rigid material such as wood, as shown in the drawings, or plastic. Other materials, such as wood composites, steel, aluminum and the like are also contemplated and fall within the purview of this invention. Referring to FIGS. 1–4, the platform 12 may include, as illustrated, specialized curved sections to enhance the look of the mechanism 10, as well as to aide in the comfortable and efficient operation thereof.

The platform 12 includes top and bottom broad faces 22 and 24, respectively. When used in conjunction with the skateboard, the top broad face 22 of the platform 12 accommodates the operator or rider, who stands thereon during operation. When used for other applications, any weight to be carried by the steering mechanism 10 is normally carried on the top broad face 22 of the platform 12.

The platform 12 further comprises first and second longitudinal sides 26 and 28, respectively, upon which a downward vertical force 66 may be applied. As will be more fully explained hereafter, the steering mechanism 10 is actuated by such a force 66, usually the weight of the operator, which is focused on either the first longitudinal side 26 or the second longitudinal side 28 of the platform 12.

The plunger 14 includes a proximate end 30 and a distal end 32. Preferably, the proximate end 30 is rigidly affixed to the bottom broad face 24 of the platform 12, while the distal end 32 of the plunger 14 extends downwardly from the platform 12 at an acute angle with the plain of the platform 12. See FIG. 4.

Figure 4:
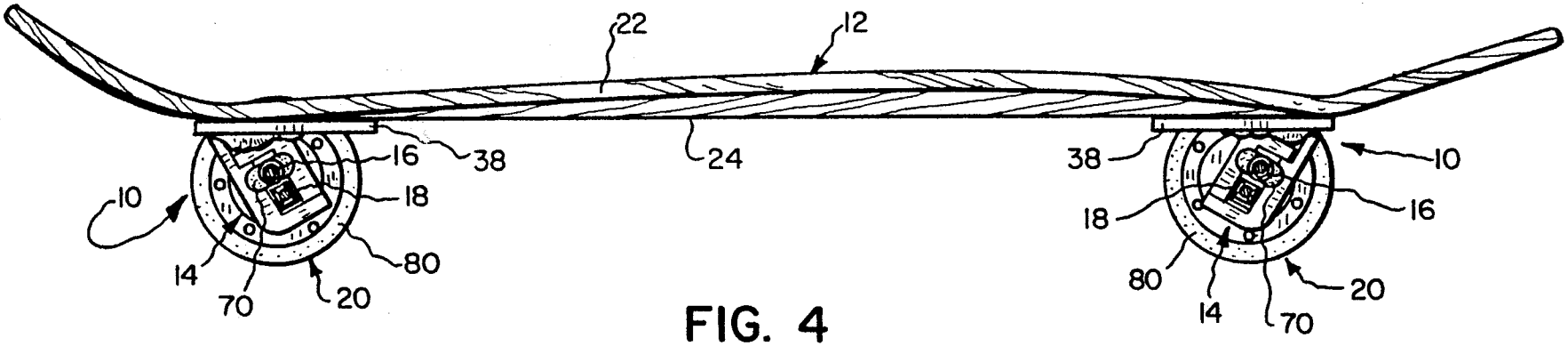
FIG. 4 is a cut-away side elevation view taken along the lines 4—4 of FIG. 1.

As best illustrated in FIG. 4, the acute angle formed by the plain of the platform 12 and the plunger 14 is approximately 30 degrees. However, indications are that acceptable results are achieved when the acute angle formed is between 15 and 45 degrees, although any angle between approximately 10 and 80 degrees will yield somewhat the desired effect and therefore falls within the scope of this invention.

Figure 5:
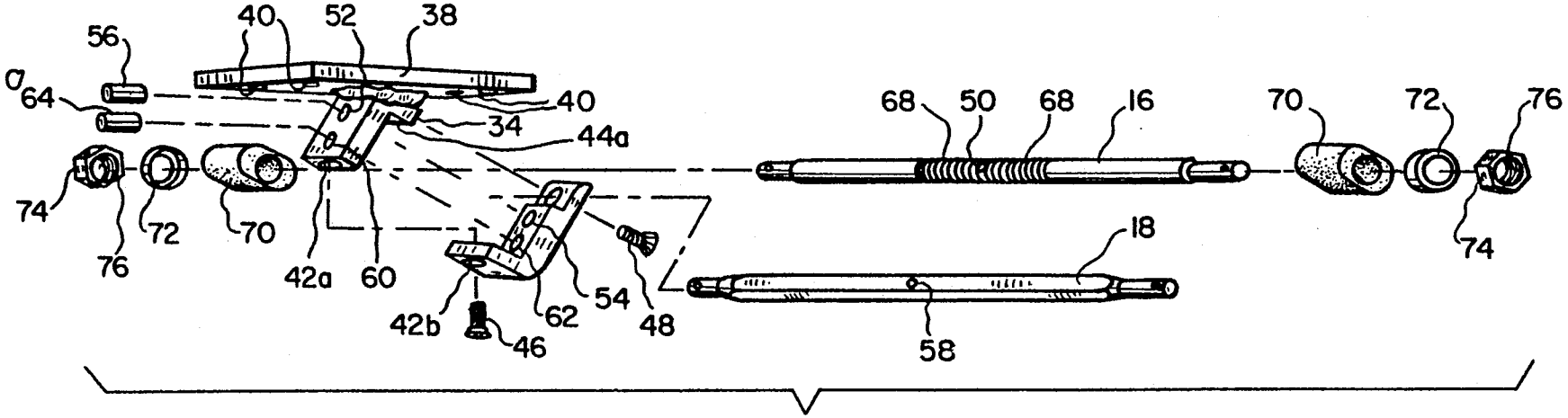
FIG. 5 is a partial, exploded perspective view of steering mechanism of the present invention.

Referring now to FIGS. 4 and 5, it will be seen that the plunger 14 secures both the top axle 16 and the bottom axle 18 in place. Also, as best shown in FIG. 5, the plunger 14 may be advantageously separated into a first piece 34 and a second piece 36. As shown, the first piece of the plunger 14 is rigidly affixed to an attachment plate 38 which forms the proximate end of the plunger 14 and whereby the plunger 14 is rigidly affixed to the bottom broad face 24 of the platform 12. The attachment plate 38 is preferably square in shape and comprises a plurality of apertures 40 to which screws, not shown, pass before screwing into the bottom broad face 24 of the platform 12.

Still referring to FIG. 5, first and second pieces 34 and 36, respectively, include corresponding apertures **42*a* and 42*b*, and 44*a* and 44*b*, through which screws 46 and 48, respectively, pass to secure the first piece 34 and second piece 36 together when the steering mechanism 10** is in use.

One skilled in the art will immediately realize that the first and second pieces 34 and 36, respectively, of the plunger 14 allow simplified and facile abilities to maintain, replace, repair the axles 16 and 18, as well as other similarly disposed components. The top axle 16 comprises an aperture 50 at its approximate mid-length which is transverse to its longitudinal axis. When in use, the aperture 50 in the top axle 16 is aligned with a top aperture 52 in the first piece 34 of the plunger 14 and a top aperture 54 in the second piece 36 of the plunger 14. When the apertures 50, 52 and 54 are aligned, a pivot pin 56 may be passed therethrough to pivotally secure the top axle 16 in place. Similarly, a transverse aperture 58 in the bottom axle 18 may be aligned with apertures 60 and 62 in the first piece 34 and second piece 36, respectively, of the plunger 14, such that when the apertures 58, 60 and 62 are in alignment, a pivot pin 64 may be passed therethrough to pivotally secure the bottom axle 18 in place.

Figure 2:
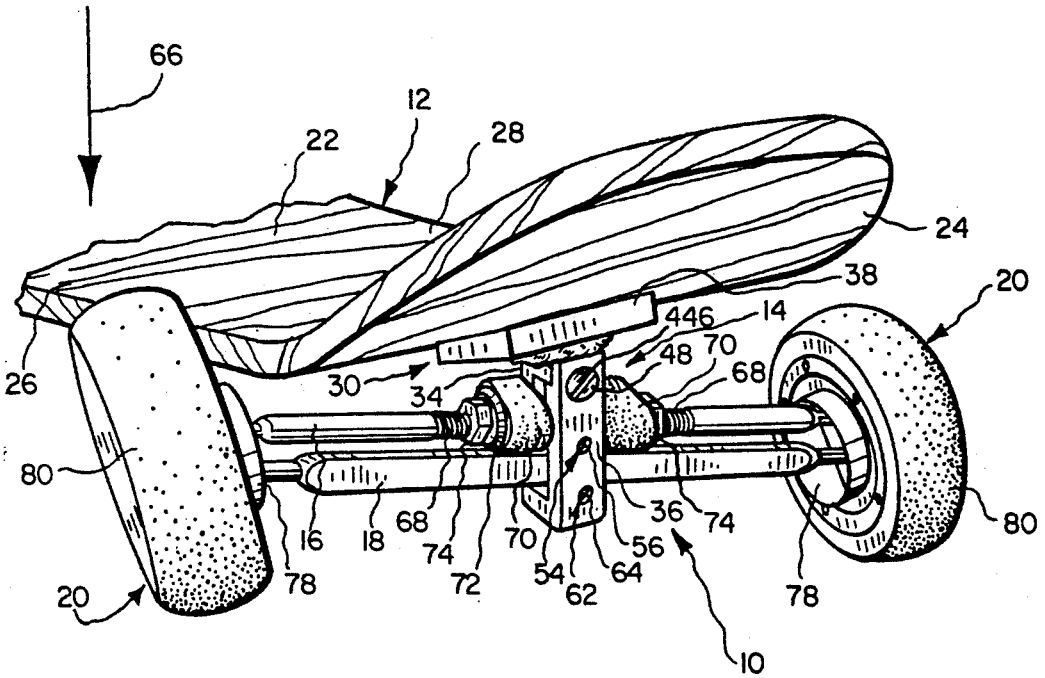
FIG. 2 is an enlarged partial perspective view of the invention of FIG. 1 illustrating both the steering and tilting capabilities of the assembly.
Figure 3:
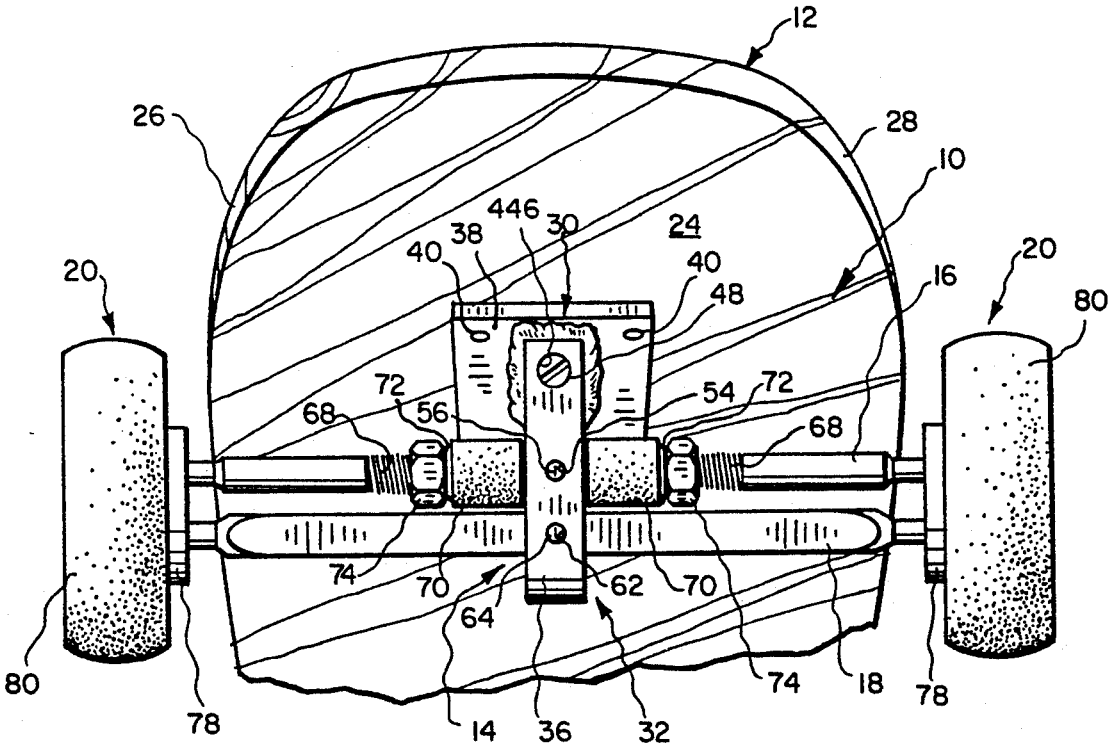
FIG. 3 is a partial front elevation view of the invention of FIG. 1.

As best illustrated in FIG. 2, FIG. 3 and FIG. 5, the top axle 16 and the bottom axle 18 are of equal length, and, when in use, disposed in a parallel aligned relationship to each other. Importantly, the axles 16 and 18 are of such a length that the wheels 20, described hereinafter, do not come in contact with the platform 12 upon exertion of a downward vertical force 66 on one of the longitudinal sides 26 or 28 of the platform 12. See FIG. 2.

One skilled in the art will understand that when a downward vertical force 66 is exerted on one of the longitudinal sides 26 or 28 of the platform 12, the top axle 16 and bottom axle 18 temporarily assume a parallel but nonaligned relationship to each other, thereby causing the wheels 20 to tilt relative to the platform 12. When no downward vertical force 66 is applied, the top and bottom axles 16 and 18, respectively, intersect the plunger 14 at right angles, as best illustrated in FIG. 3.

FIG. 2, FIG. 3 and FIG. 5 illustrate some differences between the top axle 16 and bottom axle 18. For example, in the preferred embodiment, the top axle 16 has a generally circular cross section, while the bottom axle 18 has a cross-section which is rectangular. It is to be recognized that this is merely a design preference and is therefore in no way limiting; therefore, the cross-sections of the top axle 16 and the bottom axle 18 may take any shape which is standard and acceptable in the industry.

Another difference between the axles 16 and 18 is the presence of threads 68 on the mid-shaft portion of the top axle 16. When in use, two identical rubberized cushions 70, one disposed on either side of the plunger 14, as best shown in FIG. 3, are wrapped about the top axle 16. The rubberized cushions 70 are held in position, and may be tightened or loosened, by washers 72 and nuts 74. The threads 76 and the nuts 74 are sized so as to communicate with the threads 68 disposed in the top axle 16.

One skilled in the art will immediately recognize that the threads 68 in the top axle 16, the rubberized cushions 70, the washers 72 and the nuts 74 comprise flexing means for returning and maintaining the steering mechanism in a neutral position when the longitudinal sides 26 and 28 of the platform 12 are not acted upon by a downward vertical force 66. One skilled in the art will further recognize that the parallel spacing between the axles 16 and 18 will determine the amount of tilt exhibited by the wheels 20 when the downward vertical force 66 is applied to one of the longitudinal sides 26 or 28; the more space between the axles 16 and 18, the greater the tilt.

Each of the wheels 20 is identical and therefore need only be described in detail once. In general, each wheel 20 comprises a hub 78 to which an end of both axles 16 and 18 is pivotally secured in standard fashion, a tire 80 which includes an interior surface (not shown), a race (not shown) which is fixedly attached to the interior surface of the tire 80, and a set of ball bearings (not shown) disposed between the race and the hub 78 such that the hub 78 remains in a stationary position while the race and tire 80 rotate when the steering mechanism 10 is in motion.

A preferred use of the steering mechanism 10 is the creation of a skateboard assembly which is suitable for recreational and competitive use. Such a skateboard assembly comprises a singular generally planar platform, such as the platform 12 described herein, and a pair of identical, but oppositely disposed, steering mechanisms 10, as described hereinabove. In this assembly, the platform 12 further comprises a transverse midline 82 (see FIG. 1) towards which each of the acutely angled plungers 14 angles, one steering mechanism 10 being disposed on either side of said transverse midline 82.

Although the preferred embodiment of the present invention has been illustrated and described, it is to be understood that the present disclosure is made by way of example and that various other embodiments are possible without departing from the subject matter coming within the scope of the following claims, which subject matter is regarded as the invention.

We claim:

1. A steering mechanism having both wheel tilting and wheel steering capabilities, said steering mechanism comprising:

a generally planar platform having top and bottom broad faces and having first and second longitudinal sides, a plunger having proximate and distal ends, the proximate end thereof being rigidly affixed to the bottom broad face of the platform, and the distal end extending downwardly from the platform at an acute angle with respect to a longitudinal axis of the platform, top and bottom axles of equal length disposed in parallel aligned relationship to each other, each axle intersecting the plunger and each axle being pivotally secured at an approximate midpoint to the plunger, and a pair of wheels, one end of both the top and bottom axles being pivotally secured to the first wheel and the other end of both axles being pivotally secured to the second wheel, such that when a downward vertical force is exerted on one of the longitudinal sides of the platform, the wheels tilt and turn simultaneously relative to the platform.

2. A steering mechanism as defined in claim 1, wherein the axles are of such a length that the wheels do not come in contact with the platform upon exertion of a downward vertical force on one of the longitudinal sides of the platform.

3. A steering mechanism as defined in claim 1, wherein each of the axles is pivotally secured to the plunger by a pivot pint and wherein a downward vertical force which is exerted on one of the longitudinal sides of the platform causes the axles to temporarily assume a parallel but nonaligned relationship to each other, thereby causing the wheels to tilt relative to the platform.

4. A steering mechanism as defined in claim 1, wherein the acute angle formed is between 10 and 80 degrees.

5. A steering mechanism as defined in claim 4, wherein the acute angle formed is between 15 and 45 degrees.

6. A steering mechanism as defined in claim 5, wherein the acute angle formed is 30 degrees.

7. A steering mechanism as defined in claim 1, wherein both the top and bottom axles intersect the plunger at right angles.

8. A steering mechanism as defined in claim 1, wherein each of the wheels comprises:

a hub to which an end of both axles is pivotally secured, a tire including an interior surface, a race fixedly attached to the interior surface of the tire, and a set of ball bearings disposed between the race and the hub such that the hub remains in a stationary position while the race and tire rotate when the steering mechanism is in motion.

9. A steering mechanism as defined in claim 1, further comprising flexing means for returning and maintaining the steering mechanism in a neutral position when the longitudinal sides of the platform are not acted upon by a downward vertical force.

10. A steering mechanism as defined in claim 9, wherein the flexing means comprises rubberized cushions wrapped about the top axle on either side of the intersection of the top axle with the plunger.

11. A steering mechanism as defined in claim 10, wherein the proximate end of the plunger forms an attachment plate whereby the plunger is rigidly affixed to the bottom broad face of the platform, and the plunger comprises:

a first piece which is rigidly affixed to the attachment plate, and a second piece which is demountably affixed to the first piece, such that the top and bottom axles and the rubberized cushions can be replaced without having to replace the entire steering mechanism.

12. A skateboard assembly for recreational and competitive use comprising:

a generally planar platform having top and bottom broad faces and having first and second longitudinal sides, a pair of identical, but oppositely disposed, steering mechanisms, each steering mechanism comprising a plunger having proximate and distal ends, the proximate end thereof being rigidly affixed to the bottom broad face of the platform, and the distal end extending downwardly from the platform at an acute angle with respect to a longitudinal axis of the platform, top and bottom axles of equal length disposed in parallel aligned relationship to each other, each axle intersecting the plunger and each axle being pivotally secured at an approximate midpoint to the plunger, and a pair of wheels, one end of both the top and bottom axles being pivotally secured to the first wheel and the other end of both axles being pivotally secured to the second wheel, such that when a downward vertical force is exerted on one of the longitudinal sides of the platform, the wheels tilt and turn simultaneously relative to the platform.

13. A skateboard assembly as defined in claim 12, wherein the platform further comprises a transverse midline towards which each of the acutely angled plungers angles, one steering mechanism being disposed on either side of said transverse midline.

* * * * *